US010160095B2

(12) United States Patent
Rudolf et al.

(10) Patent No.: US 10,160,095 B2
(45) Date of Patent: Dec. 25, 2018

(54) DRESSING TOOL AND METHOD FOR THE PRODUCTION THEREOF

(71) Applicant: REISHAUER AG, Wallisellen (CH)

(72) Inventors: Christoph Rudolf, Wallisellen (CH); Florian Hänni, Wallisellen (CH)

(73) Assignee: Reishauer AG, Wallisellen (CH)

( * ) Notice: Subject to any disclaimer, the term of this patent is extended or adjusted under 35 U.S.C. 154(b) by 52 days.

(21) Appl. No.: 14/905,398

(22) PCT Filed: Jul. 18, 2014

(86) PCT No.: PCT/EP2014/065484

§ 371 (c)(1),
(2) Date: Jan. 15, 2016

(87) PCT Pub. No.: WO2015/018627

PCT Pub. Date: Feb. 12, 2015

(65) Prior Publication Data

US 2016/0176018 A1 Jun. 23, 2016

(30) Foreign Application Priority Data

Aug. 7, 2013 (EP) ..... 13179579

(51) Int. Cl.
*B24B 53/12* (2006.01)
*B24B 53/04* (2012.01)
(Continued)

(52) U.S. Cl.
CPC ..... *B24B 53/12* (2013.01); *B24B 53/04* (2013.01); *B24B 53/06* (2013.01); *B24D 18/0072* (2013.01)

(58) Field of Classification Search
CPC ..... B23F 21/02; B23F 21/026; B24B 49/18; B24B 53/017; B24B 53/02; B24B 53/04; B24B 53/06; B24B 53/12; B24D 18/0072
See application file for complete search history.

(56) References Cited

U.S. PATENT DOCUMENTS 5,092,910 A * 3/1992 deKok ..... B24D 3/06 51/295
5,453,106 A * 9/1995 Roberts ..... B24D 11/001 106/36

(Continued)

FOREIGN PATENT DOCUMENTS

DE 29819006 U1 2/1999
EP 1331063 A1 7/2003

(Continued)

OTHER PUBLICATIONS

International Search Report for PCT/EP2014/065484 dated Sep. 4, 2014.

*Primary Examiner* — Timothy V Eley
(74) *Attorney, Agent, or Firm* — Brian Roffe

(57) ABSTRACT

Dressing tool including a main body having a working surface covered with hard-material grains distributed on the main body. Recesses for accommodating the hard-material grains are created in the main body and then filled with an adhesive, the excess adhesive is removed across the main body, and thereafter the hard-material grains are flung onto the main body so that only the grains located in the recesses remain adherent to the working surface of the tool. The hard-material grains can then be bonded to the main body by a physical and/or chemical bond. Thus, a distribution of the grains over the working surface of the tool that can be precisely defined in advance is ensured.

20 Claims, 2 Drawing Sheets

(51) Int. Cl.
*B24B 53/06* (2006.01)
*B24D 18/00* (2006.01)

(56) References Cited

U.S. PATENT DOCUMENTS 5,725,421 A * 3/1998 Goers ..... B24B 5/42 451/303
6,190,240 B1 * 2/2001 Kinoshita ..... B24B 53/017 451/443
6,306,025 B1 * 10/2001 Torii ..... B24B 53/017 451/443
6,478,831 B2 * 11/2002 Tselesin ..... B23D 61/021 51/293
6,702,654 B2 * 3/2004 Nanda ..... B24B 53/017 29/423
6,769,975 B2 * 8/2004 Sagawa ..... B24D 18/00 451/540
6,945,857 B1 * 9/2005 Doan ..... B24B 53/12 451/443
8,298,048 B2 * 10/2012 Sung ..... B24B 53/017 451/443
8,377,158 B2 * 2/2013 Palmgren ..... B23D 61/18 51/293
8,597,085 B2 12/2013 Rudolf
9,180,574 B2 11/2015 Wunder et al.
2003/0145843 A1 8/2003 Schwammle
2003/0205239 A1 * 11/2003 Cho ..... B24B 53/017 134/2
2007/0037493 A1 * 2/2007 Shih ..... B24D 18/0027 451/56
2009/0038234 A1 * 2/2009 Yen ..... B24D 18/00 51/295
2009/0215366 A1 * 8/2009 Ishizuka ..... B24B 53/017 451/443
2009/0325471 A1 * 12/2009 Chou ..... B24B 53/017 451/443
2011/0104989 A1 * 5/2011 Boutaghou ..... B24B 37/14 451/28
2012/0149287 A1 * 6/2012 Wu ..... B24B 53/017 451/443
2013/0316629 A1 * 11/2013 Sung ..... B24B 53/017 451/443
2016/0279758 A1 * 9/2016 Sung ..... B24B 7/228

FOREIGN PATENT DOCUMENTS

WO 2008101263 A1 8/2008
WO 2015018627 A1 2/2015

* cited by examiner

DRESSING TOOL AND METHOD FOR THE PRODUCTION THEREOF

FIELD OF THE INVENTION

The invention relates to a dressing tool which comprises a main body with a working surface and hard-material grains distributed over this working surface.

BACKGROUND OF THE INVENTION

This type of tool is disclosed in publication EP-A-2 535 145. The tool described here is used in particular for dressing grinding discs and worm grinding wheels for grinding toothed wheels and similar components. In the method of producing the tool an adhesive is first of all applied to the working surface of the tool to be produced with a defined film thickness and the hard-material grains are then applied to the working surface provided with the adhesive and remain permanently bonded here as a particle covering after the adhesive has cured.

This known method makes it possible to cover the main body quickly with the particles provided for this purpose, but not to provide a perfectly even distribution density of the hard-material grains over the working surface of the tool. This can have a negative impact upon the quality of the grinding effect that can be achieved with the tool.

OBJECTS AND SUMMARY OF THE INVENTION

The object underlying the invention is to devise a dressing tool and a method for the production thereof in which the main body of the tool is covered with improved distribution of the hard-material grains, and so with this tool optimisation of its working surface as regards its grinding effect is achieved.

According to the invention this object is achieved by recesses being created in the main body in order to accommodate the hard-material grains, the geometry of which is adapted to that of the hard-material grains. In this way, the particles accommodated in the recesses are individually positioned precisely, i.e. according to the arrangement and distribution over the recesses on the working surface of the tool. The hard-material grains can thus be applied with a defined distribution density by the recesses accommodating them being created appropriately distributed over the working surface of the tool.

A distribution density that is particularly advantageous in practice is produced by an arrangement of the recesses which results in a specific spacing of the hard-material grains relative to their insides in relation to the grain size in the finished tool.

It can also often be advantageous if the recesses, in relation to the central axis of the tool, are created more densely distributed on the outside than on the inside.

The recesses according to the invention are generally dimensioned and configured such that they can each accommodate one hard-material grain. However, within the framework of the invention it is also possible to dimension and configure the recesses depending on the grain size and/or shape of the particles such that they can each accommodate more than just one grain.

According to the invention the recesses are created in the main body by drilling into or stamping the latter. Since the main body is normally metallic, both production methods can be used without any great expenditure relating to apparatus. Depending on the composition of the main body, other production methods, such as for example laser-operated methods, can however in principle also be used.

Furthermore, the invention makes provision such that the recesses created in the main body are filled with a preferably electrically conductive adhesive, the excess adhesive being removed across the main body and thereafter the hard-material grains being flung onto the main body. In this way it is ensured that only the particles located in the recesses remain adherent to the working surface of the tool.

The invention also makes provision such that the particle covering that is produced is then galvanically nickel-plated, the layer of nickel being deposited over the adhesive and the hard-material grains being surrounded by the nickel bond. They thus remain entirely enclosed in the recesses up to a specific grain height, physical and/or chemical bonds, such as for example a nickel or solder bond, also supporting the retention of the particles in the desired direction. Within this context it is advantageous if the recesses in the main body are configured and dimensioned such that in this way a certain orientation of the hard-material grains preferably in the form of dodecahedrons is brought about.

Advantageously, the recesses are dimensioned and configured such that they can accommodate hard-material grains with a consistent grain shape and/or grain size.

BRIEF DESCRIPTION OF THE DRAWINGS

In the following the invention will be described in more detail by means of an exemplary embodiment with reference to the drawings. These show as follows.

DETAILED DESCRIPTION OF THE INVENTION

Figure 1:
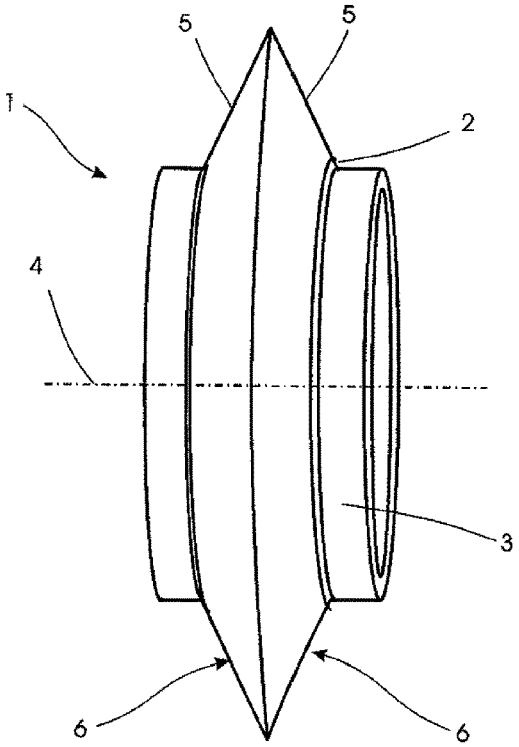
FIG. 1 is a dressing tool comprising a main body, illustrated in simplified form and slightly perspectively.

The dressing tool shown in FIG. 1 serves to dress the edges of worm grinding wheels that are used, for example, to grind correspondingly formed toothed wheels. These dressing tools can have one or a number of these main bodies 2 with a corresponding number of working surfaces 6. These working surfaces can also be provided with special profile shapes and in addition the dressing tools can be produced as dressing toothed wheels.

The dressing tool 1 consists of a main body 2 with a cylindrical shaft 3 that can be coupled to a rotary drive in order to drive the main body 2 that can be rotated about the central axis 4 of the dressing tool 1. The edges 5 of the main body 2 form the working surfaces 6 of the tool. For this purpose, they are provided with a covering of hard-material grains 7. The central axis 4 of the dressing tool 1 passes through the cylindrical shaft 3. As also seen in FIG. 1, the main body 2 is situated on the cylindrical shaft 3 and each of the working surfaces 6 on the main body 2 extend around the cylindrical shaft 3 and upward from and at an angle to an outer surface of the cylindrical shaft 3 to thereby provide each working surface 6 with a conical shape. The working surfaces 6 meet at a location spaced apart from the outer surface of the cylindrical shaft 3.

Figure 2:
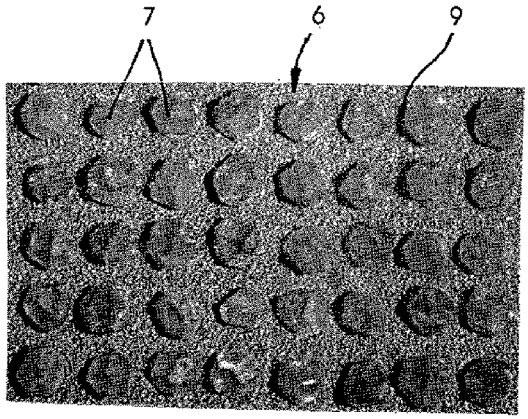
FIG. 2 is a view of a partial region of the working surface of the dressing tool according to FIG. 1.

A partial region of the covering is shown greatly enlarged in FIG. 2. In the exemplary embodiment described, the hard-material grains 7 embedded by a nickel bond 9 are provided as diamond grains with a grain diameter of, for example, 400 μm and a preferably dodecahedral form. Depending on the conditions of use, other grain shapes and sizes and other materials, such as super-abrasive or similar highly abrasive materials can of course also be used.

Figure 3:
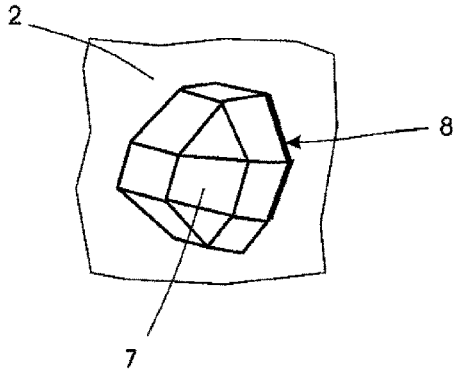
FIG. 3 is a single hard-material grain of the working surface according to FIG. 1, shown perspectively.
Figure 4:
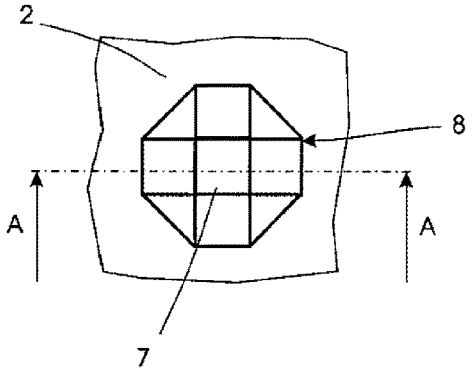
FIG. 4 is an outline of this hard-material grain according to FIG. 3.
Figure 5:
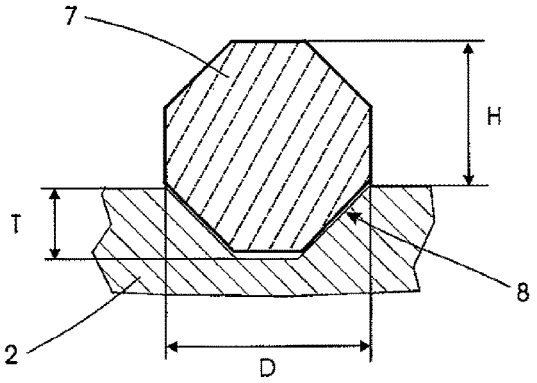
FIG. 5 is a section along line A-A according to FIG. 4.

As can be seen in detail from FIG. 3 to FIG. 5, according to the invention recesses 8 arranged with precisely defined distribution are created in the main body 2, the form and dimensions of which are adapted to those of the hard-material grains 7 so that they can accommodate grains with more or less form-fit up to a certain grain height. On the basis of their particular configuration, they are also able to give the hard-material grains 7 the alignment which is optimal for the respective function of the tool. Thus, the depth T of the respective recess and also the projecting height H of the grain can be determined, and so the parameters can be configured appropriately for optimal dressing and a maximum life span of the tool.

The recesses 8 are preferably either drilled, stamped and/or lasered into the main body 2, depending on from which material the normally metal main body 2 is produced. The distribution density of the recesses 8 over the working surface 6 of the tool is chosen so that in the finished tool the distances between the grains 7 on the inside are for example approximately half the grain size D, in the exemplary embodiment described these distances being consistent in both the horizontal and in the vertical direction.

Depending on the composition of the grains and/or functioning of the tool it is of course possible to vary the distribution density of the recesses and so that of the grain covering over the whole surface, or also from zone to zone. In the latter case the recesses 8 are distributed more densely on the outside in relation to the central axis 4 of the tool than applied to the inside so that with the finished tool the latter is provided with more hard-material grains per unit area on the outside than on the inside because in the normal case the grains lying on the outside are in use first, and so for a longer time than the particles lying on the inside.

After applying the recesses 8 to the working surfaces 6 of the main body they are filled with an electrically conductive adhesive, and the excess adhesive is then removed over the main body 2, for example with a doctor blade. Then the diamond grains 7 are flung onto the working surface 6, the grains only remaining adherent in the recesses 8 filled with adhesive. By means of a corresponding arrangement of the recesses the grain distribution over the working surface 6 can be varied in many ways. In this way precisely defined distribution of the grains over the working surface of the tool is always produced.

The design according to the invention of the tool thus basically has the advantage that it guarantees positioning of the hard-material grains over the working surface of the tool that can be specified precisely in advance. By appropriate specification of this value the tool can be improved such that it is optimal for the respective application.

The diamond covering produced can then be galvanically nickel-plated. In this case the adhesive for the diamond grains is chosen so that it is compatible with the chemicals of the subsequent galvanic process. Since the adhesive used is electrically conductive, the nickel layer can be deposited on it without any problem so that the diamond grains adhered in the recesses are enclosed neatly by the nickel bond. In this way the edges of the recesses are sealed and the diamond grains are retained better.

The exemplary embodiment described above relates to a main body for dressing tools that are intended in particular for dressing worm grinding wheels. The invention can be used as mentioned above, but also obviously with tools that work in a similar manner, such as for example grinding or honing tools.

The invention claimed is:

1. A dressing tool, comprising:

a main body with a working surface having an arrangement of recesses distanced apart from one another and which have a distribution density over the working surface in both a horizontal direction and a vertical direction such that there are horizontal rows and vertical columns of recesses on the working surface; and hard-material grains arranged in the recesses, the recesses having a form and dimensions adapted to those of the hard-material grains to result in each of the hard-material grains entering into a respective one of the recesses to a determined depth and to project from a surface of the main body a determined height, wherein all of the hard-material grains have a consistent grain size and the recesses are dimensioned to enable use of the hard-material grains with the consistent grain size, and wherein the working surface has multiple zones defined at different distances to a central axis of the dressing tool, the recesses being situated in the multiple zones and having different distribution densities in different zones.

2. The dressing tool according to claim 1, wherein the recesses cover the working surface and in at least one of the zones, have a consistent distance between adjacent ones of the recesses such that the hard-material grains have a consistent distance between adjacent ones of the hard-material grains in the recesses in the horizontal direction and a consistent distance between adjacent ones of the hard-material grains in the recesses in vertical direction.

3. The dressing tool according to claim 1, wherein the distribution density of the recesses in at least one of the zones is such that the hard-material grains have a consistent distance between adjacent ones of the hard-material grains in the recesses in the horizontal direction and adjacent ones of the hard-material grains in the recesses in the vertical direction.

4. The dressing tool according to claim 1, wherein the recesses cover the working surface.

5. The dressing tool according to claim 1, wherein the recesses have a geometry adapted to a geometry of the hard-material grains such that the hard-material grains are each arranged in the respective one of the recesses with a form-fit.

6. The dressing tool according to claim 1, wherein the distribution density of the recesses in at least one of the zones is such that distances between the hard-material grains correspond approximately in proportion to a grain size of the hard-material grains.

7. The dressing tool according to claim 1, wherein the distribution density of the recesses in the different zones is such that some of the recesses are arranged in a denser distribution on an outside of the working surface in relation to a central axis of the dressing tool than other of the recesses arranged in a less dense distribution on an inside of the working surface in relation to the central axis.

8. The dressing tool according to claim 1, wherein the recesses are at least one of drilled, stamped and lasered into the main body.

9. The dressing tool according to claim 1, wherein the recesses are dimensioned to enable specific orientation of the hard-material grains.

10. The dressing tool according to claim 1, wherein the hard-material grains have a shape of a dodecahedron and each of the recesses has a form and dimension to receive a respective one of the hard-material grains in the shape of the dodecahedron.

11. The dressing tool according to claim 1, wherein the hard-material grains have a consistent grain shape and the recesses are dimensioned to enable use of the hard-material grains with the consistent grain shape.

12. A method for producing the dressing tool according to claim 1, comprising:

filling the recesses with an adhesive; then removing any excess adhesive that is present on the working surface around the recesses; and then placing the hard-material grains into the recesses containing adhesive.

13. The method according to claim 12, wherein the adhesive is an electrically conductive adhesive.

14. The method according to claim 12, wherein the step of removing any excess adhesive that is present on the working surface around the recesses comprises manipulating a tool to operate against the working surface.

15. The method according to claim 12, further comprising bonding the hard-material grains to the main body after the hard-material grains are placed into the recesses.

16. The method according to claim 15, wherein the bonding uses nickel or solder.

17. The method according to claim 12, further comprising depositing a layer of nickel onto the working surface after the hard-material grains are placed into the recesses to enclose the hard-material grains by a nickel bond formed by the layer.

18. The dressing tool according to claim 1, further comprising a shaft through which the central axis of the dressing tool passes, the main body being situated on the shaft and the working surface on the main body extending around the shaft and upward from and at an angle to an outer surface of the shaft to thereby provide the working surface with a conical shape.

19. A dressing tool, comprising:

a shaft defining a central axis of the dressing tool;

a main body situated on the shaft, the main body including two working surfaces each extending around the shaft and upward from and at an angle to an outer surface of the shaft to thereby provide each working surface with a conical shape, the working surfaces meeting at a location spaced from the outer surface of the shaft, each of the working surfaces having an arrangement of recesses distanced apart from one another and which have a distribution density over the working surface in both a horizontal direction and a vertical direction such that there are horizontal rows and vertical columns of recesses on the working surface; and hard-material grains arranged in the recesses, the recesses having a form and dimensions adapted to those of the hard-material grains to result in each of the hard-material grains entering into a respective one of the recesses to a determined depth and to project from a surface of the main body a determined height, wherein all of the hard-material grains have a consistent grain size and the recesses are dimensioned to enable use of the hard-material grains with the consistent grain size, and wherein each of the working surfaces has multiple zones defined at different distances to the central axis of the dressing tool, the recesses being situated in the multiple zones and having different distribution densities in different zones.

20. A dressing tool, comprising:

a main body with a working surface having an arrangement of recesses distanced apart from one another and which have a distribution density over the working surface in both a horizontal direction and a vertical direction such that there are horizontal rows and vertical columns of recesses on the working surface; and hard-material grains arranged in the recesses, the recesses having a form and dimensions adapted to those of the hard-material grains to result in each of the hard-material grains entering into a respective one of the recesses to a determined depth and to project from a surface of the main body a determined height, wherein all of the hard-material grains have a consistent grain size and the recesses are dimensioned to enable use of the hard-material grains with the consistent grain size, and wherein the distribution density of the recesses is such that some of the recesses are arranged in a denser distribution on an outside of the working surface in relation to a central axis of the dressing tool than other of the recesses arranged in a less dense distribution on an inside of the working surface in relation to the central axis.

* * * * *